United States Patent [19]

Braver

[11] 4,127,162

[45] Nov. 28, 1978

[54] MODULAR AIR CONDITIONING APPARATUS

[75] Inventor: Alvin S. Braver, Oklahoma City, Okla.

[73] Assignee: International Environmental Mfg. Corp., Oklahoma City, Okla.

[21] Appl. No.: 684,454

[22] Filed: May 7, 1976

Related U.S. Application Data

[63] Continuation of Ser. No. 482,133, Jun. 24, 1974.

[51] Int. Cl.[2] ..... F24F 3/08

[52] U.S. Cl. ..... 165/50; 123/65 R; 123/76

[58] Field of Search ..... 165/50, 58, 27, 65, 165/64, 76

[56] References Cited

U.S. PATENT DOCUMENTS

| | | | |
|---|---|---|---|
| 2,798,366 | 7/1957 | Erl | 165/76 |
| 3,179,162 | 4/1965 | McFarlan | 165/50 |
| 3,251,540 | 5/1966 | Kinsworthy | 165/58 |
| 3,302,695 | 2/1967 | Payne | 165/27 |
| 3,411,569 | 11/1968 | Hildreth | 165/65 |
| 3,648,766 | 3/1972 | Whalen | 165/50 |
| 3,722,580 | 3/1973 | Braver | 165/50 |
| 3,731,056 | 5/1973 | Becker | 165/65 |
| 3,742,725 | 7/1973 | Berger | 165/76 |
| 4,019,570 | 4/1977 | Siegel | 165/76 |

*Primary Examiner*—Charles J. Myhre
*Assistant Examiner*—P. S. Lall

[57] ABSTRACT

An improved modular air conditioning apparatus featuring selective panel enclosures, plug-in controls, orientation selection and servicing capability, the apparatus comprising an open box frame having three access sides which are each selectable for enclosure or component orientation. A blower and heat exchanger are disposed in an operating section of the frame, and these are removable through an access port provided by the removal of an intake grille disposed at one of the access sides. Riser pipes disposed in a vertical riser duct connect with other like units and supply hot or chilled water to the heat exchanger. A plug-in control assembly senses an external temperature and controls the operation of the blower which draws air through the heat exchanger and blows the air into a plenum section of the frame from which the air exits through an outlet grille.

2 Claims, 7 Drawing Figures

MODULAR AIR CONDITIONING APPARATUS

CROSS REFERENCE TO RELATED APPLICATION

The present invention is a continuation of U.S. Patent application Ser. No. 482,133, filed June 24, 1974, and now pending.

BACKGROUND OF THE INVENTION

1. Field of the Invention

The present invention relates generally to improvements in air conditioning apparatus, and more particularly, but not by way of limitation, to modular air conditioning apparatus.

2. Description of the Prior Art

The prior art provide teachings of heating and cooling units of the type utilizing a blower and heat exchanger arrangement for passing air over a coil through which a heated or chilled fluid heat transfer medium passes. Further, the prior art contains teachings of such units receiving a heated or chilled fluid heat transfer medium from a central source recirculating unit. A common method is practiced whereby the air conditioning apparatus is located in close proximity to an air conditioned area, the air conditioning apparatus being permanently disposed between and generally hidden from view by the wall partitions of the area, as are the supply pipes for the recirculated fluid heat transfer medium. Such units may be found in the prior art patents to Kritzer, U.S. Pat. Nos. 3,181,604; Lincoln, 2,255,292; O'Brien, 2,072,427; and in my patent, U.S. Pat. No. 3,722,580.

A problem that has arisen with the prior art air conditioning units involves the servicing of such units once they have been installed. These units often require the removal of a wall partition to gain access to the working components of the units, and it is often required that the complete air conditioning apparatus be removed in order to make repairs or modifications.

SUMMARY OF THE INVENTION

The present invention contemplates an air conditioning apparatus of the type requiring a connection to a source of recirculated fluid heat transfer medium, the air conditioning apparatus being disposable between wall partitions separating and defining areas which are to be air conditioned. An open box frame is provided that comprises a plurality of generally vertically disposed frame struts that define three access sides and a non-access side. A blower is supported on the frame so as to separate the frame into an upper portion and into a lower portion. The upper portion serves as a high pressure plenum section and the lower portion serves as a low pressure operating section. The blower draws air from the operating section and blows the air into the plenum section. A heat exchanger is disposable in the operating section along one of the three access sides as desired, and a detachable intake grille is supported thereat and defines a component servicing port through which the blower and the heat exchanger are serviceable. An outlet grille is disposed at one of the three access sides to provide an air exit port for the plenum section. A supply riser pipe, a condensate drain riser pipe, and a return riser pipe comprise a riser conduit assembly disposed at the non-access side of the open box frame. A plug-in assembly is provided for sensing the temperature of the air in the air conditioned area and for controlling the operation of the blower.

An object of the present invention is to provide an improved air conditioning apparatus that facilitates the servicing of the working components of apparatus.

Another object of the present invention is to provide an improved air conditioning apparatus that is disposable behind the wall partitions of a building and which is partially enclosed by such wall partitions.

Other objects, features, and advantages of the present invention will be apparent to persons having ordinary skill in the art from the following detailed description of presently preferred embodiments of the invention given for the purpose of disclosure when taken in conjunction with the accompanying drawings.

DESCRIPTION OF THE PREFERRED EMBODIMENT

The present invention relates to modular air conditioning units that are supplied with a flow-through heat exchange medium from an external source. These units are used in the construction of multistory buildings, often referred to as high rise buildings. The term "air conditioning", as used herein, refers to the heating or cooling of air in a room area or the like to maintain the temperature of the air within a desired temperature range.

The present invention relates to an improved combination and arrangement whereby is provided modular air conditioning high rise units that give a wide range of versatility such that a field installer can order units that are best suited for a particular installation. As will become clear below, the modular units can be factory fitted so as to have enclosing panels affixed to the vertical sides of the open box frame, or the units can be left open for enclosing by the field application of approved, fire retardant building materials. In any event, once the modular units are installed, all of the working components can be easily serviced, a feature which is extremely important to the lifetime maintenance costs of a building. It will also be pointed out that the disclosed design offers other advantages, such as providing a quieter operating unit.

After installation of a plurality of the improved air conditioning units of the present invention at a building site, the installed units are provided with flow through chilled water from a central chilling unit for air cooling, or with heated water from a central boiler for air heating. In some installations, it will be desirable o provide electrical heating and to provide chilled water to the units, thereby providing simultaneous heating and cooling capability. Of course, it is also possible to achieve simultaneous heating and cooling capability by the provision of separate supply and return riser pipe pairs by the addition of independent heating and cooling coils in the heat exchanger unit.

Figure 1:
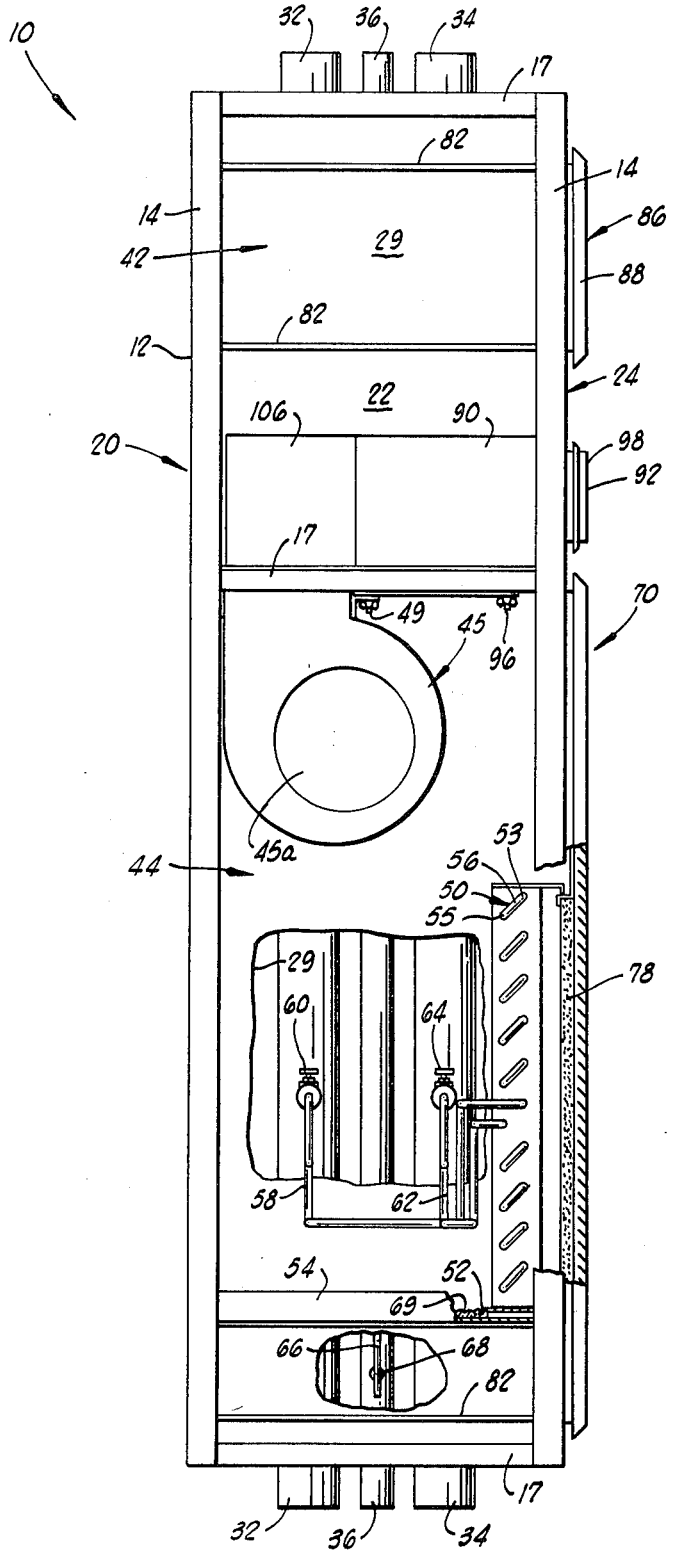
FIG. 1 is a front elevational view of the improved air conditioning apparatus of the present invention having partial cutaway portions thereof to show the riser pipe connections.
Figure 2:
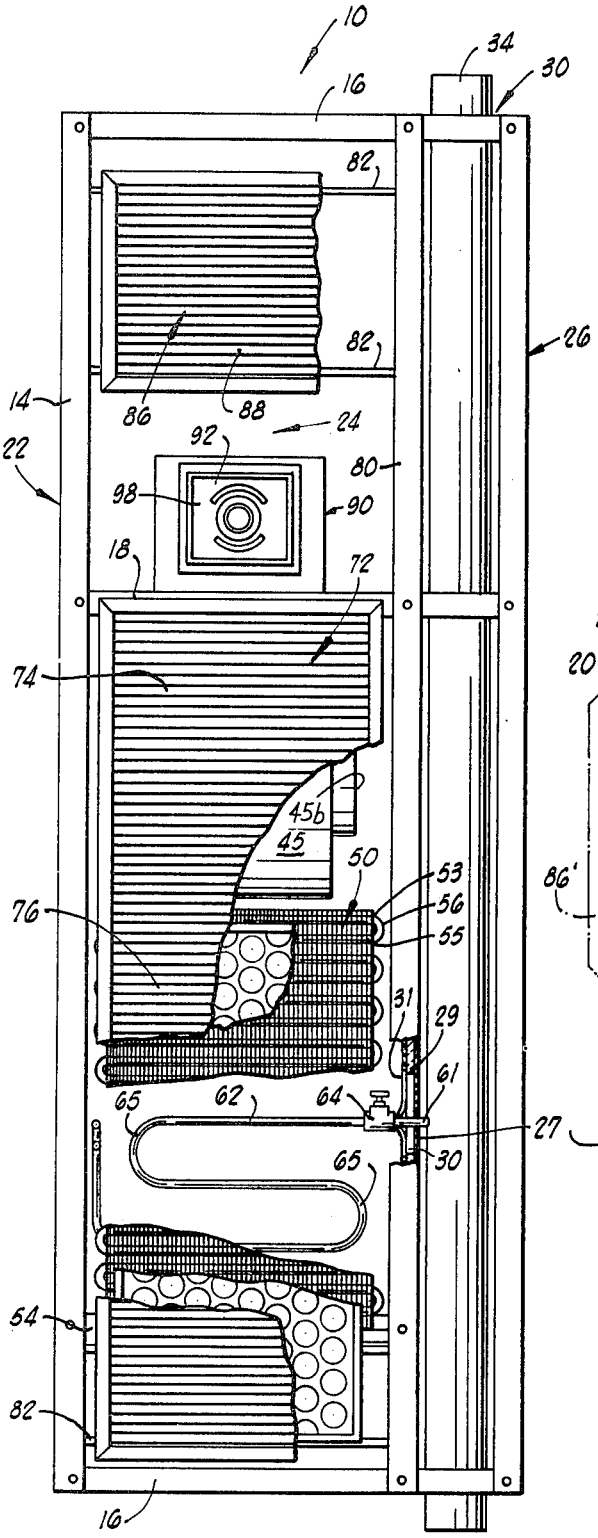
FIG. 2 is a side elevation of the improved air conditioning apparatus shown in FIG. 1 and having partial cutaway portions thereof to show the working components and riser pipe connections.
Figure 3:
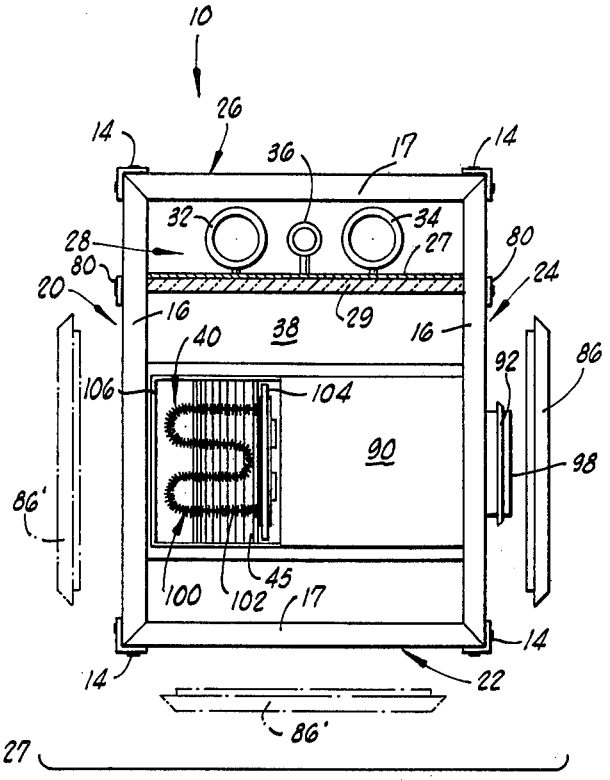
FIG. 3 is a top view of the improved air conditioning apparatus of the present invention with the top panel removed.

Referring to the drawings in general, and particularly to FIGS. 1 through 3, the air conditioning apparatus of the present invention is generally designated therein by the reference numeral 10. The air conditioning unit 10 comprises an open box frame 12 comprising the vertically disposed frame struts 14 that are held in spaced apart relationship by the cross braces 16, 17, and 18 that are connected thereto.

The frame 12 is referred to herein as an open box frame, because of the general accessibility to the interior of the frame 12 through the access planes defined by the vertical sides 20, 22, and 24 of the air conditioning unit 10, the vertical sides 20, 22, and 24 are also referred to herein as access sides. The vertical side 26 at the rear of the frame 12 will be referred to as the non-access side.

The members 14, 16, 17, and 18 are preferably made from galvanized steel angle iron stock because of the problem of condensation and the attendant corrosive problems encountered in air conditioning apparatus. Accordingly, it is advisable for the air conditioning apparatus 10 to be constructed of corrosion resistant materials throughout.

As best shown in FIG. 3, a vertically disposed galvanized sheet metal panel 27 is connected to the frame 12 to form a riser duct 28 disposed between the panel 27 and the non-access side 26. A sheet of fire retardant insulation material 29 is adhered to one side of the sheet metal panel 27. The insulation material 29 may be ½ inch fiberglass batts and may be neoprene coated. As shown in FIG. 2, a clearance slot 30 is provided for pipes that extend into the riser duct 28, and a slotted neoprene foam rubber sheet 31 is provided to partially seal the clearance slot 30. The sheet metal panel and the fire retardant insulation 29 serves to form a fire and sound barrier, and since these members are permanently attached to the frame 12, the side 26 becomes a non-accessible plane as accessibility to the working components of the air conditioning apparatus 10 is presented.

It should be noted that the air conditioning apparatus 10 has been shown in FIG. 3 with a slight deviation from the construction used. In practice, a sheet of metal is riveted to the cross struts 16 and 17 at the top of the frame 12 to form a top panel member, and this top panel member has not been included in FIG. 3 in order to more clearly show the working components of the air conditioning apparatus 10. This top panel is also insulated in the manner that insulation batts 29 have been attached to the panel 27.

A riser supply pipe 32 and a return riser pipe 34 are vertically disposed in the riser duct 28 and fixably secured therein (the fixture means is not shown in the drawings, but it will be understood that conventional clamping means are utilized to establish the location of the riser pipes). In like manner, a condensate drain riser pipe 36 is also positioned in the riser duct 28 generally parallel to the riser pipes 32 and 34, and is fixedly secured therein.

A square shaped mid-panel 38 having an opening 40 is supported by the cross struts 18 and the connecting struts 17 near the middle of the frame 12, thereby defining a plenum section 42 and an operating section 44 of the frame 12. The mid-panel 38 has a square configuration for a reason that will be discussed below.

Figure 4:
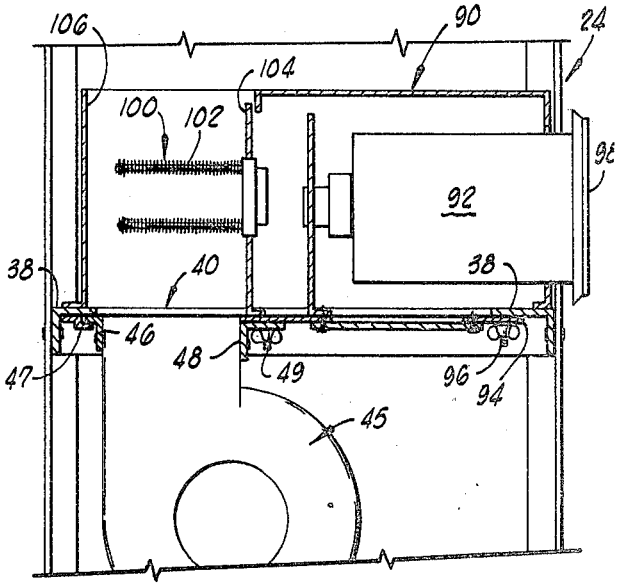
FIG. 4 is an enlarged and partial cutaway view showing the electrical resistive heater and the electrical controls of the embodiment shown in FIG. 1.

A motor driven blower 45 is supported by the mid-panel 38 and is disposed in the operating section 44 by means more clearly shown in the enlargement view of FIG. 4. The blower 45 has a longitudinal member 46 attached along one of its top edges that is engaged by a retaining member 47 attached to the underside of mid-panel 38 in the manner shown. Located in like manner to the member 46 is the longitudinal member 48 attached along an opposite edge of the blower 45. Several threaded stud bolts 49 (one of which is shown having a wing nut retainer) extend from the mid-panel 38 and securedly pass through apertures in the member 48. The arrangement affords quick removal of the blower fan 45 from hanging engagement with the mid-panel 38, and it also provides for easy replacement thereof with correct alignment being assured by the positive guiding action of the described connector.

The motor-driven blower 45 is a centrifugal, direct drive type of blower and functions to draw air from the operating section 44 and to blow the air into the plenum section 42. The blower 45 is disposed in the operating section 44 and draws air through a heat exchanger described below. The blower 45 has a scroll blower unit 45*a* of conventional design and a driving motor 45*b*.

The electrical connections to the air conditioning apparatus 10 are not shown in the figures, as these are conventional and need not be discussed for purposes of this disclosure. It is suggested that the wiring to the blower 45 be disposed in a flexible conduit, and that a slack loop be placed in the conduit so as to permit the removal of the fan for inspection and repair without electrical disconnection.

The mid-panel 38 is square shaped so that it can be oriented in three different directions. That is, the mid-panel 38 may be positioned with its opening 40 in close proximity to any one of the three access sides 20, 22 or 24 by simply turning the mid-panel 38 accordingly, and securing the mid-panel 38 in the desired orientation relative to the access sides 20, 22 and 24. This arrangement permits the selective orientation of the components supported by the mid-panel 38 for a reason discussed below.

A heat exchanger 50, supported by a base support 52, is disposed in the operating section 44 and is positionable along one of the three access planes or sides 20, 22, or 24. A drain pan 54 is disposed in the lower portion of the operating section 44 and supported therein by means connecting it to the frame struts 14. As shown in the partial cutaway of the drain pan 54 in FIG. 1, the base support 52 rests in the bottom of the drain pan and is secured thereto in any convenient manner such as by bolt and lip means. Although the heat exchanger 50 is shown adjacent to the selected access plane 24 for purposes of illustration, it will be understood that it is readily disposable at either of the access planes or sides 20 and 22 as well.

The heat exchanger 50 has a coil comprising a plurality of parallel, finned tubes 56 connected to provide for the passage of a heat exchange fluid medium through the heat exchanger 50, which is conventional in heat exchange art. One end of the coil of the heat exchanger 50 is connected to the supply riser pipe 32 via a supply tube 58, a shut off valve 60, and a stub nipple 61, which communicatingly connects to the supply riser pipe 32 and extends through the clearance slot 30 in the sheet metal panel 27 and the insulation batts 29. The neoprene sheet 31 is slotted and forms a partial seal about the stub 61. In practice, the riser pipes 32 and 34 are known to expand in their linear directions, causing the stub 61 to move generally in an upward or downward direction, and the neoprene sheet 31 is slotted to provide a seal at any position of the stub 61 as it moves with the movement of the riser pipes.

In like manner, a return tube 62 is connected to the other end of the coil of the heat exchanger 50 and connects to the return riser pipe 34 via a combination shut off and balancing valve 64 and a stub nipple 61 that communicatingly connects with the return riser pipe 34. In the illustration of the figures, the supply tube 58 and the return tube 62 serve to stabilize the heat exchanger coil 50 in its vertical disposition. Additional support may be provided as required.

As shown in FIGS. 1 and 2, the tubes 56 of the heat exchanger 50 form a double layer arrangement; that is, the coil comprising the tubes 56 passes in a transverse path across the heat exchanger 50 so as to have a front layer 53 and a back layer 55. This arrangement illustrates a benefit of placing the heat exchanger in the operating section. That is, air is drawn across the heat exchanger 50 at the low input pressure of the blower 45 as opposed to the situation wherein a heat exchanger is placed downstream to a blower and consequently heats the high pressure output air of the blower. With the air drawing relationship of the blower 45 to the heat exchanger 50 in the present invention, a larger space can be allocated to the heat exchanger, and a more even air distribution over the heat exchanger coil can be achieved. That is, the velocity of air moving across the heat exchanger coil is more uniform over the entire area of the heat exchanger.

Another advantage of placing the heat exchanger 50 in the operating section 44 is that the connecting tubes 58 and 62 need not be insulated as would be the case if these connecting tubes were disposed in the plenum section 42. The reason for this is that the tubes 58 and 62 are subjected only to the low pressure inlet air that passes through the heat exchanger 50, and not to the expanding air emitted from the blower 45. It should also be noted that each of the tubes 58 and 62 are provided expansion loops 65 which presents no spatial problem by virtue of the heat exchanger being disposed in the more spacious operating section 44.

The drain pan 54 has a centrally located drain aperture (not shown) to which is attached a drain tube 66 that is connected to the condensate drain riser pipe 36 by means of a flexible hose coupling stub nipple 68. Also, a slot and partial neoprene seal is provided in the manner described above for the stub nipples 61.

Connected to the frame 12 adjacent to and in front of the heat exchanger 50 is an intake grille assembly 70 that is removably supported on the frame 12. The intake grille assembly 70 comprises a louvered grille panel 72 that has a solid section 74 and an air passing section 76. The upper solid section 74 does not permit air passage, but the lower air passing section 76 permits air to pass through the grille panel 72 en route to the heat exchanger 50. Disposed at the back side of the grille panel 72 is a filter 78 that filters the air passing through the grille panel 72. This filter is removably attached to the grille panel 72 so as to be changed or cleaned as required.

A vertically extending support strut 80 is connected to the cross struts 16 and 18 and supports a horizontal grille support 82 located near the lower part of the frame 12 at each of the access sides 20 and 24. Each of the supports 82 also attaches to one of the frame struts 14. A similar strut 82 is supported by the appropriate frame struts 14 at the access side 22. It has been found convenient to attach the grille assembly 70 by the use of resilient spring clips that press against the underside of the cross support 18 and the top of the grille support 82 located near the bottom of the intake grille assembly 70, as shown for the access side 24 in FIG. 2.

The intake grille assembly 70 provides a route for return air to be received by the air conditioning apparatus 10, and the intake grille assembly 70 is sized so that when it is removed, the intake grille assembly 70 leaves an access port through which the heat exchanger 50 and the motor-driven blower 45 can be serviced from the return air opening.

An outlet grille 86, having a louvered grille panel 88, is detachably supported by the upper grille support struts 82 by means of appropriate spring clips or the like. As shown in FIG. 3, the outlet grille 86 may be positioned at any one of the access planes 20, 22 or 24 (as depicted by the dashed outline of the outlet grille 86'). Appropriately spaced grille support struts 82 are disposed generally horizontally for the attachment of the outlet grille 86 thereto. It may be that the air conditioning apparatus 10 will be required to service more than one occupancy area, and this may be achieved by providing more than one outlet grille 86. In some installations that use plural outlet grilles 86, there exists the possibility of light or sound traveling from one occupancy area through the unit to another occupancy area serviced by the same unit. Appropriately disposed baffles may be placed in the plenum section 44 to prevent this undesirable result.

Disposed in the plenum section 42 and supported by the mid-panel 38 is a plug-in control assembly 90 that has a temperature sensor 92 extending through the selected access plane 24. The positioning of the sensor 92 relative to the access sides 20, 22 or 24 may be selectively determined by orienting the mid-panel 38. The plug-in assembly 90 is an electrical apparatus that controls the speed and operating times of the electric motor **45*b* of the blower unit 45** and comprises conventional temperature sensing and set point apparatus that need not be described herein.

It should be noted that the control assembly 90 is supported by the mid-panel 38 so that it is unplugable by the reach of a repairman's arm through the opening 40 in the mid-panel 38. Referring to FIG. 4, the base plate 94 of the control assembly 90 is attachable by appropriately located stud bolts 36 extending from the underside of the mid-panel 38. The stud bolt 49 serves to attach both blower 45 and the control assembly 90 to the mid-panel 38. The sensor 92 has a removable face plate 98 that is projected beyond the access plane 24. All electrical connections to the control assembly 90 and the blower unit 45 are provided with mating plugs and receptacles so that these components may be easily removed from the apparatus 10.

The embodiment of the present invention illustrated in FIGS. 1 through 4 is equipped with an auxiliary heater 100 comprising a resistance wire coil 102 supported by a plate 104 that is one side of a box 106 supported by the mid-panel 38 and which serves as an extension to the nozzle of the blower 45 through which the air exiting from the blower 45 must pass. The structure of the heater 100 is conventional, and its inclusion herein is shown as an optional addition to the heating capability of the heat exchanger 50. The appropriate electrical wiring necessary to operate the heater 100 is not shown in the figures. While capable of being utilized as the sole heating means for apparatus 10, the heater 100 also enables the apparatus 10 to provide both heating and cooling capability during the season of the year in which only cooling water is supplied to the apparatus 10 via the riser pipes 32 and 34. Additional riser pipes and heat exchanger coils may be provided to give concurrent heating and cooling capability, in which case the heater 100 may not be necessary, or the heater 100 may be provided as a backup unit in the event of difficulty with the hot water source.

When the air conditioning apparatus 10 is provided with the heater 100, some fire codes require that the plenum section 42 be enclosed by a fire retardant material or by a metal sheet. This is readily achievable, once the orientation of the working components is selected (such that the intake grille assembly 70, etc., are located at one of the access sides 20, 22 or 24), by welding, riveting or otherwise attaching the enclosing material to the outside of the open box frame 12 and to the top thereof so as to enclose the plenum section 42. It should be noted that the enclosing of the plenum section as described (not shown in the figures) does not impede the accessibility to the operating section 44, which is an important feature of the air conditioning apparatus 10.

Figure 5:
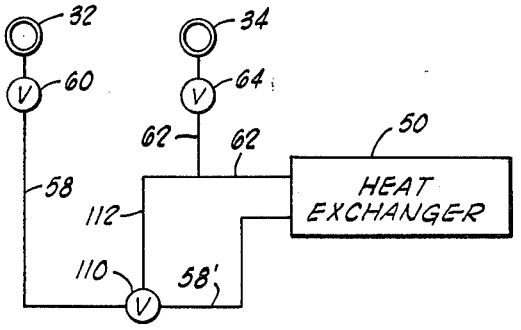
FIG. 5 shows a piping diagram for an electrically controlled three-way flow control valve connection.

Also included in the preferred embodiment, but not shown in the FIGS. 1 through 4, is a valving arrangement represented by FIG. 5. The apparatus 10 may be provided with an electrically controlled bypass valve 110 that is electrically controlled together with the blower 45 by the sensor 92. As shown in FIG. 5, one port of the three-way valve 110 is connected to the supply tube 58, and another port of the valve 110 is connected to a supply tube 58' that leads to the heat exchanger 50. The third port of the three- way valve 110 is connected to a tube 112 that connects to the return tube 62. In operation, when the three-way valve 110 is energized with the blower 45 to be in an operating mode, the valve 110 permits fluid communication between the supply tube 58 and the supply tube 58', and the valve 110 is closed to the tube 112. This operating mode allows normal operation of the heat exchanger 50. On the other hand, when the blower 45 and the electrically controlled three-way valve 110 are in a non-operate mode, the valve 110 permits fluid communication between the supply tube 58 and the tube 112, and the valve 110 prevents fluid communication to the supply tube 58'. In this non-operate mode, fluid supplied by the supply riser 32 passes through the supply tube 58 and the tube 112 to the tube 62 to return to the return riser 34 without passing through heat exchanger 50.

Figure 6:
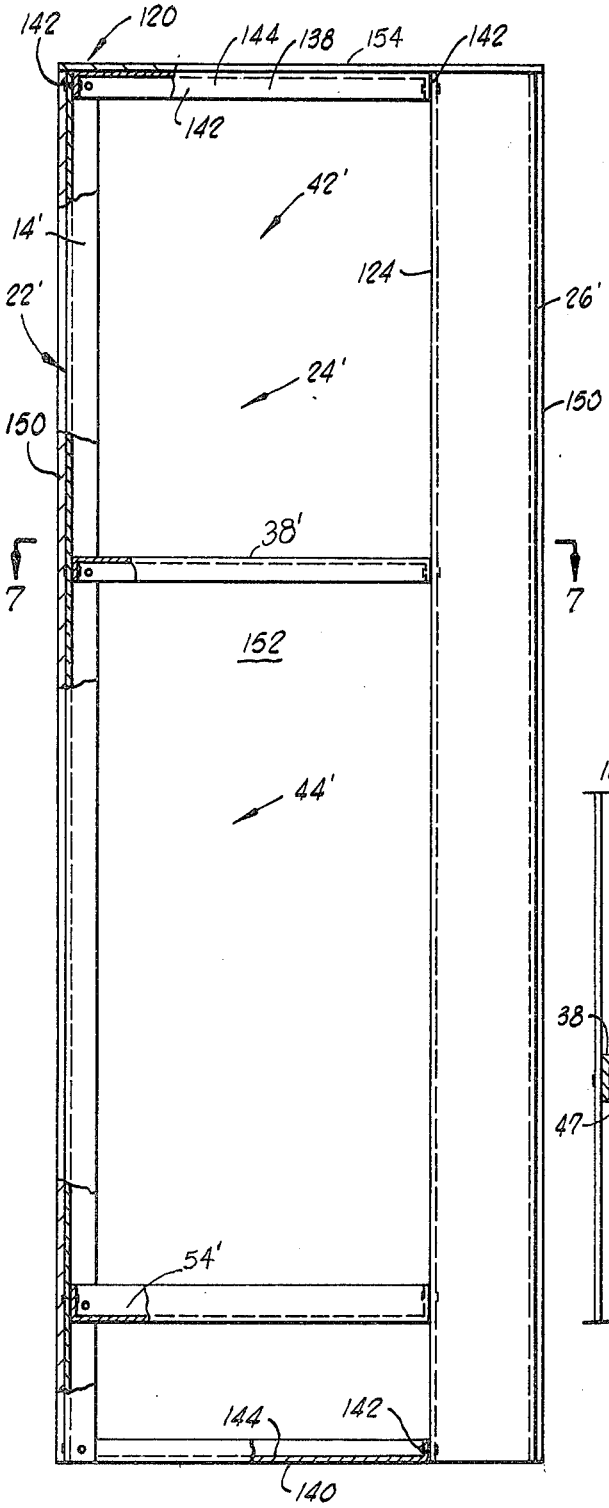
FIG. 6 shows another embodiment of the open box frame of the air conditioning apparatus of the present invention, less the operating components thereof.
Figure 7:
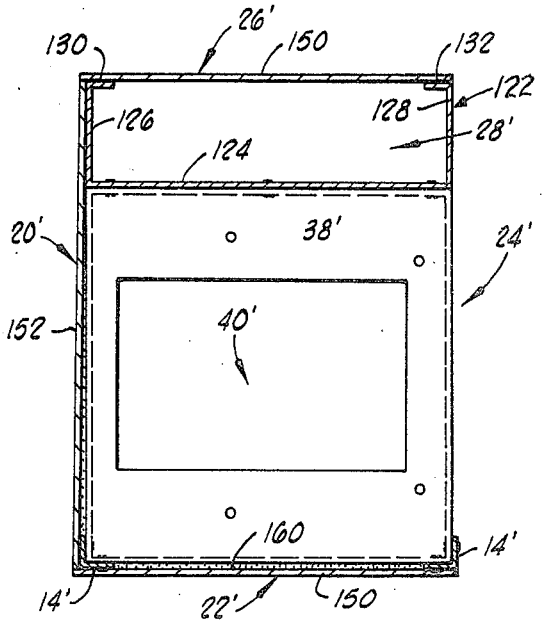
FIG. 7 is a cross sectional view taken at 7—7 in FIG. 6.

FIGS. 6 and 7 show an open box frame 120 of modified construction to that of the open box frame 12 that has been described above. The open box frame 120 is shown stripped of all the working components of the air conditioning apparatus 10 in order to illustrate its construction. Primed numbers are used in FIGS. 6 and 7 where the members of the open box frame 120 correspond to members of the open box frame 12 that has been described in detail above.

The open box 120 comprises a pair of angle iron frame struts 14' in generally vertical disposition and parallel to each other, forming two of the vertical corners of the frame. The riser duct 28' is formed by a metal sheet 122 formed to have a front panel 124 and the side panels 126 and 128. Also a pair of lips 130 and 132 are formed respectively from the side panels 126 and 128 so as to project into the non-access plane 26', as shown. The frame struts 14' and the riser duct 28' are held in spaced apart relationship by an end panel 138 and an end panel 140 that are located at opposite ends of the frame 120. The horizontal end panels 138 and 140 are each made from metal sheet stock formed to have flanges 142 extending along the peripheral edges of a plate 144. The end panels 138 and 140 are welded or riveted to the frame struts 14' and the riser duct 28'.

Also attached between the struts 14' and the riser duct 28' are a mid-panel 38' and a drain pan 54', both of which are generally parallel to the end panels 138 and 140. The mid-panel 38' is generally similar to the end panels 138, 140 except that the mid-panel 38' has an opening 40', as can be seen in FIG. 7, which is a cross sectional view taken at 7—7 in FIG. 6. The purpose of the opening 40' in the mid-panel 38' is the same as has been described above for the opening 40 in the mid-panel 38 of the apparatus 10. The drain pan 54' is constructed substantially the same as drain pan 54 described above.

The sides of the open box frame 120 have been covered by panels, with a pair of panels 150 that cover the access plane 22' and the non-access plane 26', while a wider panel 152 covers the access plane 20'. Also, a top panel 154 is attached between the struts 14' and the duct 28' to seal the end of the plenum section 42'. The open box frame 120 is provided as an illustration to show the enclosing of the open box frame 120, with the access plane 24' left open pending installation of the various components of the air conditioning apparatus of the present invention. It will be understood that the open box frame 12 of the embodiment shown in FIGS. 1 through 4 could as well be enclosed with panels such as shown in FIGS. 6 and 7.

A number of materials are suitable to serve as the construction material from which the enclosing panels 150 and 152 are made. A fire retardant material is preferable and will be required in some installations. As shown in FIG. 7, caulking material 160 may be used to seal the panels so that a pressure seal is formed between the plenum section 42' and the operating section 44'.

OPERATION OF THE PREFERRED EMBODIMENT

The following discussion of the operation of the preferred embodiment will generally be confined to a discussion of the air conditioning apparatus 10 as disclosed and described for the FIGS. 1 through 4. However, the operation of an air conditioning apparatus of the present invention having an open box frame 120 operates in precisely the same manner as the embodiment to be discussed hereunder.

The air conditioning apparatus 10 may be conveniently installed between the wall partitions that separate two adjacent room areas of a building structure. The air conditioning apparatus 10 has been designed in contemplation of such usage, and it is therefore contemplated that the open box frame 12 may be enclosed on the job site by an approved material that is placed over the access planes 20, 22 and 24, with the material appropriately outlining the grille panels 72, 88, and the sensor portion 92 of the control box 90. In the alternative, the open box frame 12 may be provided enclosing panels at the factory as described above.

The open box frame 12 provides accessibility through a selected access side as discussed (in the illustrations herein, the access side 24 has been selected), and the size of the intake grille assembly 70, is such as to form an access port when detached from the apparatus 10 through which all of the working components of the apparatus 10 can be reached or removed as required for repair or replacement.

A plurality of riser pipes are vertically disposed for the purpose that the air conditioning apparatus 10 may be used as a stacked unit as taught in U.S. Pat. No. 3,722,580. For purposes of this disclosure, a single supply riser pipe 32 and a single return riser pipe 36 have been shown. However, additional riser pipes may be provided as required, and additional heat exchanger coils may be added to the heat exchanger as required.

In operation, a heated or chilled fluid heat transfer medium is supplied to the air conditioning apparatus 10 through the supply riser pipe 32. The fluid heat transfer medium is supplied to the heat exchanger 50 through the stub nipple 61, the shutoff valve 60 and the supply tube 58. The fluid heat transfer medium circulates through the heat exchanger 50, to flow through the return tube 62, the combination shut off and balancing valve 64 and the stub nipple 61 to the return riser pipe 34 to return for reheating or rechilling. The valve 64 serves as a shut-off and balancing valve, this valve being opened as required to provide ample back pressure on the heat exchanger 50 to fill the coil for maximum heat transfer.

Air from the room area being air conditioned is drawn through the air passing section 76 of the intake grille assembly 70 and through the filter 78, the air being drawn over the finned tubes 56 of the heat exchanger 50 into the operating section 44 by the motor-driven blower 45. The blower 45 blows the air through the opening 40 in the mid-panel 38 into the plenum section 42 from which the air exits through the grille 86 into the room area being air conditioned.

In order to cool the air in the room area being air conditioned, chilled heat transfer medium such as chilled water must be circulated through the heat exchanger 50. As the air is drawn over the resultingly chilled surface of the finned tubes 56, heat is transferred from the air to the fluid heat transfer medium in the heat exchanger 50 thereby lowering the temperature of the air prior to its being blown into the plenum section 42 and through the outlet grille 86. Conversely, in order to heat the room area being air conditioned, a heated fluid heat transfer medium such as hot water is supplied to the heat exchanger 50. As the air passes over the resultingly heated surface of the finned tubes 56, heat is transferred to the air from the fluid heat transfer medium thereby raising the temperature of the air prior to its passage into the room area being air conditioned through the outlet grille 86. The thermostat control (the temperature sensor 92) senses the temperature of the air of the room area being air conditioned, and the blower 45 will be turned on or shut off according to this control. The operation of the three-way valve 110 has been adequately discussed above, and it is sufficient to restate here that its purpose is to coordinate the flow of the heated or chilled water through heat exchanger 50 with the operation of the blower 45.

The operation of the electrical resistive heater 100 is conventional, being controlled by the control box 90 in the manner above described, the blower operation being interlocked therewith to insure proper heat dissipation from the heater.

To inspect or repair the air conditioning apparatus 10, complete access to all of the working components is readily available by removal of the intake grille assembly 70 from the frame 12. This provides an access port through which access to the interior of the frame 12 is gained. The heat exchanger 50 may be removed after disconnecting the supply tube 58 and the return tube 62 from the valves 60 and 64. The blower 45 is easily removed from the mid-panel 38 by removing the retaining wing nuts from the stud bolts 49, and pulling the blower down and toward the access port provided by the removal of the intake grille assembly 70. Sufficient slack is provided in the electrical connections to allow pulling the blower 45 outside of the frame 12. In like manner, the heater 100 (if included) and the control assembly 90 are easily removed (once the blower 45 is removed) by removing the face plate 98 (which is usually press fitted on) and the retaining wing nuts from the stud bolts 96. This permits the lowering of the control assembly 90 and the heater 100, and the plug-in electrical connections permit quick disconnection of these components.

The blower 45 with its motor **45*b* is disposed in the operating section 44 in air drawing relationship to the heat exchanger 50. Because of its location, the motor 45*b* is constructed to produce less internal heat dissipation; that is, the motor 45*b*** is permitted a smaller operating temperature rise (approximately 15° F.) over ambient temperatures, whereas motors normally are permitted up to about 70° rise over ambient. Suitable motors for the purpose of the present invention are manufactured by the General Electrical Company as thermally protected, shaded pole Model 5KSP29BK, or as thermally protected split capacitor Model 5KCP29BK.

With the blower 45 disposed in the more spacious operating section, a larger scroll blower can be used as opposed to the tightly wound scroll blowers normally used when located in the plenum section. Since a larger scroll can be used, less electrical power per unit of air moved is experienced, and the blower operates more quietly.

The present invention is well-adapted to carry out the objects and attain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. An improved air conditioning apparatus of the type requiring connection to a source of fluid heat transfer medium for air conditioning an area and disposable behind wall partitions or the like, comprising:

an box frame having three open access sides;

a mid-panel having an opening therethrough and supported by the frame and separating the frame into an upper plenum section and a lower operating section;

a blower supported by the mid-panel in the operating section and disposed to blow air from the operating section through the opening in the mid-panel into the plenum section;

a heat exchanger supported on the frame in the operating section and positioned along a selected one of the access sides;

control means for sensing the temperature of the air in the area and for controlling the operation of the blower in response thereto;

an outlet grille supported by the frame along one of the access sides and disposed to direct air from the plenum section;

an intake grille removably supported by the frame and positionable at the selected access side in intake air relationship to the heat exchanger, the intake grille assembly defining an access port through which the blower, the heat exchanger and the control means are selectively removable from the operating section;

a vertical supply riser pipe supported by the frame and having fluid communication with the heat exchanger;

a vertical return riser pipe supported by the frame and having fluid communication with the heat exchanger;

a vertical condensate drain riser pipe supported by the frame;

a drain pan supported by the frame below the heat exchanger;

a drain tube connecting the drain pan and the condensate drain riser pipe; and an electrical heater supported by the mid-panel in the plenum section and disposed in air heating relationship to the air blown by the blower through the opening in the mid-panel.

2. The apparatus of claim 1 further comprising:

enclosure panels enclosing the frame along the two access sides not selected as the selected one of the three access sides along which the heat exchanger is disposed.

* * * * *

UNITED STATES PATENT OFFICE

CERTIFICATE OF CORRECTION

Patent No. 4,127,162 Dated November 28, 1978

Inventor(s) Alvin S. Braver

It is certified that error appears in the above-identified patent and that said Letters Patent are hereby corrected as shown below:

Patent Office

Column 2, line 5, between of and apparatus should be --the--.

Ours

Column 3, line 4, "o" should be --to--.

Column 3, line 45, "serves" should be --serve--.

Column 3, line 49, "presented" should be --prevented--.

Column 4, line 18, "The" should be --This--.

Column 6, line 56, "36" should be --49--.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*